US005111946A

United States Patent [19]

Glanz

[11] Patent Number: 5,111,946

[45] Date of Patent: May 12, 1992

[54] SAFETY BOTTLE

[76] Inventor: Elliot Glanz, 4005 Greentree Dr., Oceanside, N.Y. 11572

[21] Appl. No.: 620,050

[22] Filed: Nov. 30, 1990

[51] Int. Cl.[5] ..... B65D 39/04; B65D 47/36

[52] U.S. Cl. ..... 215/247; 215/249; 220/229

[58] Field of Search ..... 215/247, 231, 249, 253, 215/309, 310, 311; 220/229

[56] References Cited

U.S. PATENT DOCUMENTS

| | | | |
|---|---|---|---|
| 686,642 | 11/1901 | Wayte | 215/247 |
| 1,413,703 | 4/1922 | Biehn | 215/247 |
| 2,099,370 | 11/1937 | Monnier | 215/247 |
| 2,200,600 | 5/1940 | Grapp | 215/247 |
| 2,241,097 | 5/1941 | Mezzapesa | 215/247 X |
| 2,436,291 | 2/1948 | Daniel | 215/247 X |
| 2,848,130 | 8/1958 | Jesnig | 215/247 X |
| 2,857,068 | 10/1958 | Kraepelin | 215/231 |
| 2,906,423 | 9/1959 | Sandhage | 215/249 |
| 3,392,859 | 7/1968 | Fischer | 215/247 |
| 3,712,498 | 1/1973 | Lawrence | 215/247 |
| 3,823,840 | 7/1974 | Zackheim | 215/247 |
| 3,870,183 | 3/1975 | Luczkiw | 215/247 |
| 3,872,992 | 3/1975 | Larson | 215/249 |
| 3,938,686 | 2/1976 | Milligan et al. | 215/232 |
| 3,977,555 | 8/1976 | Larson | 215/247 |
| 4,293,078 | 10/1981 | Percarpio et al. | 215/247 |
| 4,362,698 | 12/1982 | Boosalis et al. | 215/247 X |
| 4,513,871 | 4/1985 | Meierhoefer | 215/247 X |

*Primary Examiner*—Stephen P. Garbe
*Assistant Examiner*—Vanessa Caretto
*Attorney, Agent, or Firm*—Schweitzer Cornman & Gross

[57] ABSTRACT

An improved safety bottle includes a cover preferably formed of ethyl vinyl acetate, and having a cut through its top to create an integral one-way valve. The valve remains closed, securing the bottle contents against spillage and the like until opened by contact by an appropriate tool, such as a dropper or tweezers. Under such contact the valve pivots downwardly, allowing the tool to be inserted with the bottle to access the contents. When the tool is removed the valve closes, sealing the contents within the container. Both H and U-shaped cuts can be employed.

5 Claims, 2 Drawing Sheets

SAFETY BOTTLE

BACKGROUND OF THE INVENTION

The present invention relates to a new and improved container and, in particular a cover for such a container which provides for the safe storage of materials while allowing for their controlled removal from the container. Such a container has particular value as a storage container for chemical compounds and the like intended for utilization by youngsters as may be found in hobby chemistry sets and the like, for it allows an increased level of protection against spilling and the like of the contents while permitting the removal of amounts of the contents as required in conjunction with the performance of experiments. It also serves as a barrier between the user and the contents during reaction, and presents the inadvertent contact with the contents.

U.S. Pat. No. 1,713,321 of May 24, 1929 to Becker discloses a bottle cap having a pair of tabs formed integrally with the cap, the tabs being intended to be rotated to a position perpendicular to the top at which point they serve as a lifting means to remove the cap from the bottle. The tabs when rotated create small openings through the cap.

U.S. Pat. No. 3,369,689 of Feb. 20, 1968 to Dodge relates to a vacuum container cap having an integral tape bonded to the periphery of the closure. Lifting the free end of the tape breaks the vacuum seal created by the closure at which point the central portion of the closure pops upward, indicating the nonvacuum state exists.

U.S. Pat. No. 2,241,435 of May 14, 1941 to White discloses a container having a sliding top cover which overlies a cut in the top surface of the container. Sliding the cover portion allows controlled dispensation of the contents.

It may be appreciated that such prior art does not provide a mechanism by which controlled removal of the contents may be obtained upon insertion of an appropriate removal tool, while allowing for the resealing of the container upon tool removal.

BRIEF SUMMARY OF THE INVENTION

Such and other objects and purposes of the present invention are accommodated by the provision of a container having an openneck portion sealed by a cover, preferably press-fit or otherwise secured, formed of an appropriate elastomeric construction. Incised upon the generally flat top of the cover is an H-shaped cut, which forms a pair of integral opposed flaps. Insertion of an appropriate object, such as a dropper or grasping tweezers, through the cut pivots the flaps downwardly out of a sealing relationship with the cover, and permits the ingress of the object. With the object inserted, liquid, for example, may be introduced into the container or a portion of the contents divided or grasped by the object for removal. Upon withdrawal of the object, the flap returns to the sealed position, thus preventing inadvertent removal or spillage of the contents. As the cover is intended to remain on the container at all times, the contents of the container remain in the sealed condition at all times except when intended access to the contents occurs. Thus, the risk of accidental contact with the contents or spillage and loss thereof is substantially reduced.

Such a container may also be used as a reaction vessel, the cover substantially preventing splatter and the escape of vapors while permitting the insertion of components for the reaction.

A fuller understanding of the present invention and the attendant attributes and advantages thereof will be obtained upon consideration of the following detailed description of a preferred embodiment thereof when considered in conjunction with the annexed drawings.

DETAILED DESCRIPTION OF A PREFERRED EMBODIMENT

Figure 1:
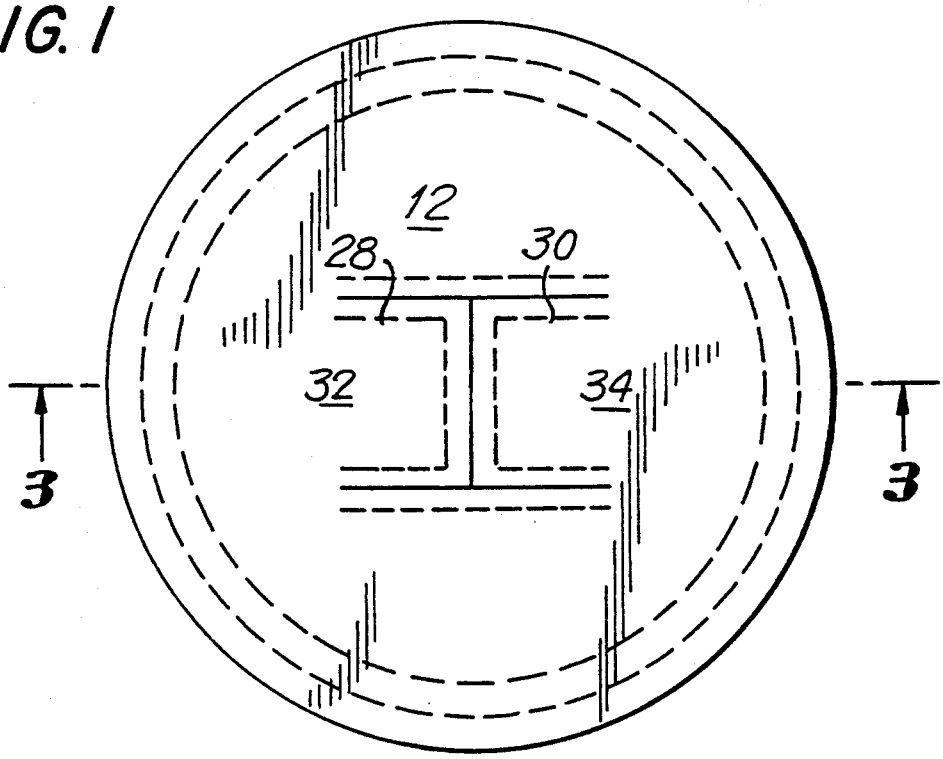
FIG. 1 is a top plan view of the cover of the invention.

With reference to the Figures, cover 10 comprises planar top portion 12 bounded by depending side wall 14. Top portion 12 is typically circular in plan, with side wall 14 being cylindrical and having an outer diameter such as to form a friction-fit with the neck opening 16 of a container 18 upon which the cover is installed. To facilitate the fit of the cover upon the container, side wall 14 may include a lower, inwardly-tapered portion 20. Alternatively, the side wall may be provided with threads to engage complementary threads on the bottle neck, or may be otherwise adapted to be firmly received by the container. Top portion 12 preferably extends somewhat beyond side wall 14, forming a lower peripheral ledge portion 22 which sits upon the top surface of the container neck 24 and prevents the cover from being improperly inserted into the neck of the bottle.

Located centrally on the top portion 12 of the bottle is generally H-shaped slit 26 which creates a pair of opposed valve element flaps 28, 30, each supported and pivotly attached to the cap by the bridging portions 32,34 of the cap material, respectively. To provide the required flexibility, the top is manufactured of an appropriate flexible, but resilient material, such as plastic. Of such plastics, ethyl vinyl acetate (EVA) is preferred. The edges of each valve element flap are beveled at 36, as are the abutting portions of the cap.

Figure 3:
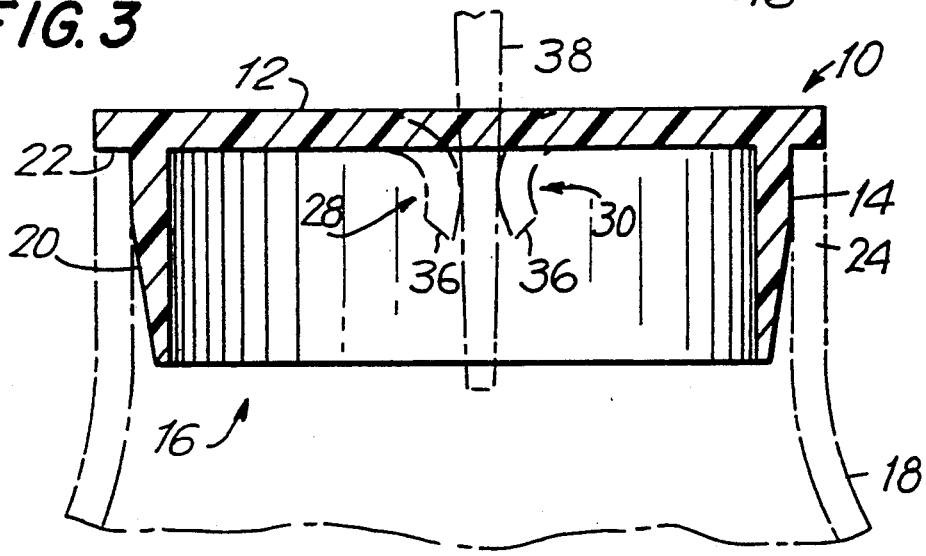
FIG. 3 is an elevation view in section taken along line 3—3 of FIG. 1 showing the cover of the invention in place upon an opentop container and through which a contents-removing object has been inserted.

As best seen in FIG. 3, the cover 10 is installed upon the neck of the container such that the top portion 12 rests upon the top of the neck, supported by lower peripheral edge 22. Thus inserted, the cap provides for a seal of the bottle, as the valve elements 28,30 normally remain co-planar with the top portion 12, the valve element edges being in an abutting relationship with each other and the adjacent cap portions. When access to the contents is required, an appropriate object, such as dropper or other object 38, is placed in contact with the central portion valve elements, as defined by the bar of the "H", and directed downwardly. Such downward force causes the valve element to pivot downwardly away from the top portion, separating and allowing the tool to be inserted through the opening created between them in the top to access the material within the container. If the tool 38 is a dropper, appropriate liquid may be introduced, while the introduction of other tools will similarly and appropriately allow the addition or removal of contents as so dictated. Because of the separation of the valve elements from the stationery top portions which occurs along both the leg and bar portions of the "H", venting is provided during the insertion/extraction process to insure that liquids can be transferred between the inserted object and the container without difficulty.

Figure 2:
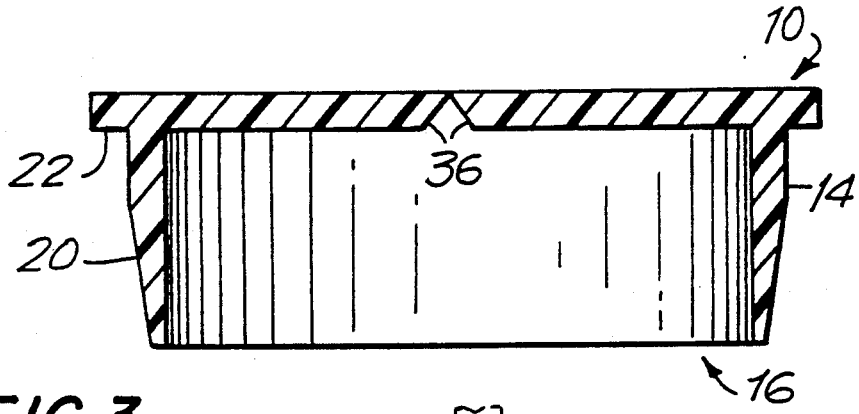
FIG. 2 is an elevation view in section taken along line 3—3 of FIG. 1 of the invention.

When the appropriate operation is completed, retraction of the object 38 allows the valve elements to return to the co-planar position, such as depicted in FIG. 2, again sealing the entranceway to the container thus preserving the contents and preventing their inadvertent removal.

Figure 4:
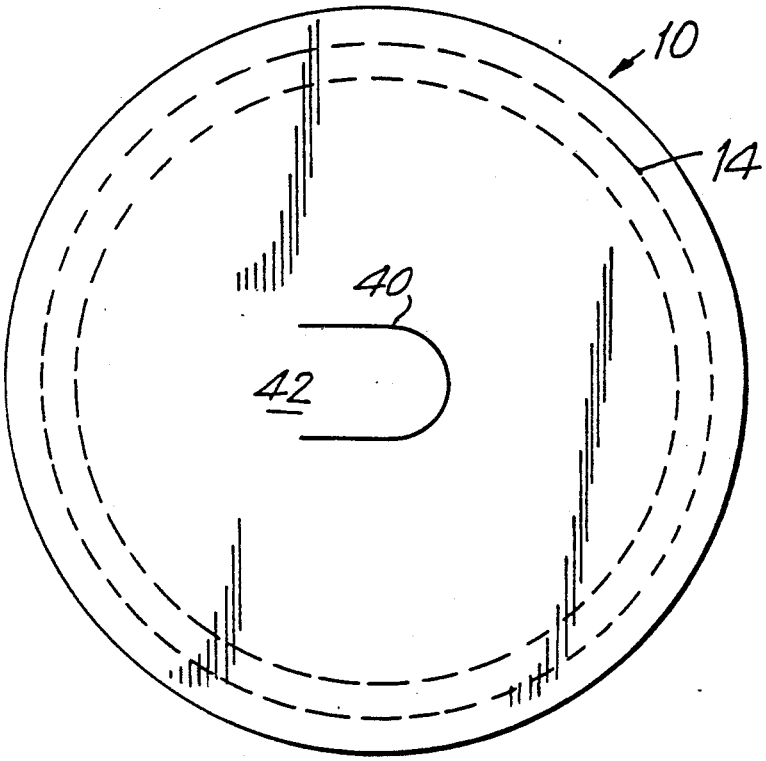
FIG. 4 is a top plan view of another embodiment of the cover of the invention.

In a second embodiment of the invention, depicted in FIG. 4, a U-shaped cut 40 is provided to define a single valve flap element 42, which pivots inwardly about bridging portion 42. Operation of the valve is otherwise similar to that of the previous embodiment.

I claim:

1. A safety container comprising a container chamber having a walled necked aperture for access thereinto and a cover frictionally insertable within said aperture, said cover having a generally flat top and a peripheral depending side wall, said side wall adapted to engage the wall of said necked aperture, said top having an integral, one-way valve located therein, said valve comprising flap means formed by said top, the flap means having edges, the edges of said flap being beveled, said valve being adapted and dimensioned to allow insertion of an object through said top into the interior of said container chamber to withdraw contents therefrom, while otherwise sealing the chamber to prohibit escape of contents, an intermediate portion of said top acting as hinge means for said flap means.

2. The container of claim 1, wherein said flap means comprise a pair of generally rectangular abutting flaps defined by an H-shaped cut in said cover.

3. The container of claim 2, wherein said side wall comprises a lower, inwardly-tapered portion.

4. The container of claim 1, wherein said flap means comprise a single flap member defined by a U-shaped cut in said cover.

5. The container of claim 4, wherein said side wall comprises a lower, inwardly-tapered portion.

* * * * *